US007159760B2

(12) United States Patent
Pluck et al.

(10) Patent No.: US 7,159,760 B2
(45) Date of Patent: Jan. 9, 2007

(54) PACKAGE FOR DELICACIES AND METHOD FOR PACKAGING DELICACIES

(75) Inventors: Deborah Pluck, Veghel (NL); Helena Johanna Raphaël Tolido, Veghel (NL)

(73) Assignee: Mars, Incorporated, McLean, VA (US)

( * ) Notice: Subject to any disclaimer, the term of this patent is extended or adjusted under 35 U.S.C. 154(b) by 154 days.

(21) Appl. No.: 10/433,299

(22) PCT Filed: Dec. 4, 2001

(86) PCT No.: PCT/NL01/00879

§ 371 (c)(1),
(2), (4) Date: Jan. 7, 2004

(87) PCT Pub. No.: WO02/46050

PCT Pub. Date: Jun. 13, 2002

(65) Prior Publication Data

US 2004/0112768 A1 Jun. 17, 2004

(30) Foreign Application Priority Data

Dec. 6, 2000 (EP) ..... 00204359

(51) Int. Cl.
*B65D 25/06* (2006.01)
*B65D 5/4805* (2006.01)

(52) U.S. Cl. ..... 229/120.09; 206/748; 206/749; 206/750; 220/520; 229/4.5; 229/902; 229/906

(58) Field of Classification Search ..... 229/120.02, 229/120.09, 902, 906, 4.5; 206/746, 747, 206/748, 749, 750; 426/119, 120; 220/520, 220/527

See application file for complete search history.

(56) References Cited

U.S. PATENT DOCUMENTS 561,574 A * 6/1896 Dorticos ..... 206/748
786,077 A * 3/1905 Wehmeier et al. ..... 220/520
1,600,687 A * 9/1926 Mantz ..... 229/4.5
1,912,875 A * 6/1933 Warner ..... 229/120.09
2,020,876 A 11/1935 Clark et al.
2,296,389 A * 9/1942 Levkoff ..... 206/749
2,324,436 A * 7/1943 Snyder ..... 206/748
2,771,986 A * 11/1956 Bekoff ..... 206/45.3
2,929,543 A * 3/1960 Feder ..... 229/4.5
3,474,949 A * 10/1969 Shine ..... 229/120.09
3,540,576 A * 11/1970 Looney et al. ..... 206/749
3,872,965 A * 3/1975 Taub ..... 206/748
4,809,847 A * 3/1989 Schneider ..... 229/120.01
5,188,223 A * 2/1993 Brose et al. ..... 206/760
5,857,570 A * 1/1999 Brown ..... 229/120.09

FOREIGN PATENT DOCUMENTS

GB 406680 2/1934
GB 1106269 3/1968

* cited by examiner

*Primary Examiner*—Gary E. Elkins
(74) *Attorney, Agent, or Firm*—Fitzpatrick, Cella, Harper & Scinto

(57) ABSTRACT

A package for several delicacies comprising compartments, which are pivotally connected to the sides of a polygonal bottom part. The package includes a closed position wherein the bottom part forms a portion of a flat bottom of a container for the delicacies, each compartment is a part of the container, and the package comprises vertical flat walls meeting at substantially vertical edges. The package further includes an open position wherein the compartment have been pivoted downwards forming several holders for delicacies that are open at the upper sides of said compartments and the package can rest on a flat supporting surface with the edges of the flat walls.

8 Claims, 6 Drawing Sheets

PACKAGE FOR DELICACIES AND METHOD FOR PACKAGING DELICACIES

The invention relates to a package for several delicacies, such as chocolates, cookies, candies and all other edible products, wherein the delicacies that are present in the package may either be unpackaged delicacies or delicacies that are packaged individually or in batches Such a package functions to keep a number of delicacies together and sell them as one unit. Such a package may also function to present the delicacies for consumption, however, wherein the package is placed on a table in open position, for example, so that the delicacies can readily be removed from the package by hand. In such a case it is important that the package forms a suitable package for transporting and storing the delicacies in its closed position, and that the package forms a container from which the delicacies can readily be taken by hand in the open position.

The object of the invention is to provide a package for several delicacies that comprises a closed position, with the delicacies present therein, and an open position, wherein the package forms a suitable container for presenting the individual delicacies.

According to the invention, in order to accomplish that objective, the package comprises compartments and the package have a closed position, wherein each compartment is a part of a container for the delicacies, and a open position, wherein the compartments have been pivoted downwards forming several holders for delicacies that are open at their upper sides.

The delicacies that are present inside the package may furthermore be packaged individually or in batches, for example in the form of stacks of jointly packaged delicacies.

Preferably, in closed position of the package, a wall part of each compartment forms a portion of a flat bottom of said container. When transforming the package from the closed position into the open position said wall part hinges downwards together with the relevant compartment to form said holder.

Preferably a compartment comprises wall parts which are disposed at the upper side and at the bottom side of the package in the closed position thereof, and which form sidewalls of the compartments (or holders) in the open position of the package, and said compartment comprises wall parts which form side walls of the package in the closed position of the package and which form the bottom wall of the compartment in the open position of the package.

In one preferred embodiment the package is bounded in its closed position by a polygonal bottom surface and a similar upper surface, which surfaces extend parallel to each other, and by a number of rectangular surfaces extending substantial perpendicularly to said bottom surface. Thereby said rectangular surfaces forming the sides of the package in closed position may incline inward so that said upper surface is smaller then said bottom surface.

Preferably, a compartment comprises a wall part that lies in the same plane as the bottom part in the closed position of the package, so that said wall parts and said bottom part jointly form a flat bottom of the package in the closed position thereof. The package may comprise only two compartments positioned opposite each other.

In one preferred embodiment the package comprises substantial vertical edges in its closed position, at which edges flat walls meet, and the package can rest on a flat supporting surface with said edges in its open position, whereby said edges extend in horizontal direction and form a stable support for the open package.

Preferably, the package includes a cover which, in the closed position of the package, closes the upper side of the container, which cover extends over the side walls of said container. The use of such a cover, in which a transparent window may furthermore be present, makes it possible to fix the compartments in the position they occupy in the closed position of the package. As an alternative the cover can be completely made of transparent material.

In one preferred embodiment a central part of the container is provided with a gripping element, which can be taken hold of by hand once the cover that may be present has been removed. This makes it possible to hold a bottom part of the package whilst the compartments pivot downwards upon opening of the package.

Preferably the bottom of the container is provided with a dividing element, which forms walls between the compartments in the closed position of the package. Thereby said gripping element may be attached to said dividing element.

The dividing element may also strengthen the bottom part to which it is attached, thus forming an adequate connection between the compartments attached thereto. Preferably the dividing element extends up to the upper side of the package in the closed position thereof.

In one preferred embodiment said package contains delicacies having a shape that matches the shape of a compartment, such that one delicacy or a specific number of delicacies fits in said compartment. In this way each compartment can contain a number of delicacies in a specific position that makes it easier to take out the delicacies by hand.

In one preferred embodiment the compartments are pivotally connected to a bottom part, which bottom part forms a portion of the flat bottom of said container in closed position of the package, which bottom part preferably has the form of an polygon, with a pivotable compartment being present on two or more sides of the polygon.

The bottom part may be strengthened, if necessary, for example by means of ribs or an additional layer of material, so that it will form a solid base to which the compartments are pivotally connected.

In one preferred embodiment the bottom part is in the form of an equilateral polygon, with a pivotable compartment being present on each side. The wall of the compartment that lies in the plane of the bottom part in the closed position of the package may be triangular thereby, such that the package, in the closed position thereof, will have a bottom in the form of an equilateral polygon comprising twice as many sides as the bottom part.

Preferably, the bottom part is in the form of an equilateral triangle, wherein the wall part of a compartment that bounds each of the sides of said triangle is triangular in shape, such that said wall parts, together with the bottom part, form a hexagonal bottom of the package in the closed position of said package. As a result, the package can be readily stacked in its closed position, and in addition to that it has an attractive form.

In another preferred embodiment the bottom part is square in shape, wherein the wall part of a compartment bounding each of the sides of said square is triangular in shape, such that said wall parts, together with the bottom part, form a square bottom of the package in the closed position of said package. In that case the package will be square in shape in its closed position, seen in top plan view, so that the closed package will have the shape of a rectangular parallelepiped.

The invention furthermore relates to a method for packaging delicacies, wherein the delicacies are packaged in a package as described above.

In order to explain the invention more fully, two embodiments of the package will be described hereafter with reference to the drawing.

The figures are merely schematic representations, wherein like parts are numbered alike.

Figure 1:
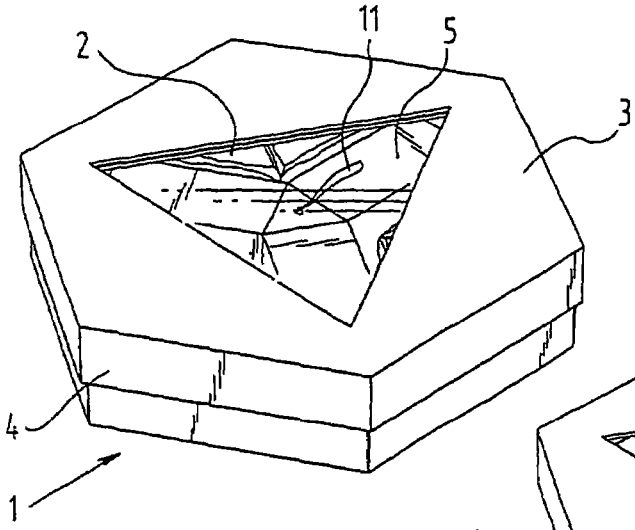
FIG. 1 is a perspective view of a first embodiment of a package in closed position.

FIG. 1 shows a first embodiment of a package in closed position, which package consists of a container 1, in which packaged triangular pieces of chocolate 2 are present, and a cover 3, which closes the upper side of container 1 and which includes parts 4 that extend over the sides of container 1.

Figure 2:
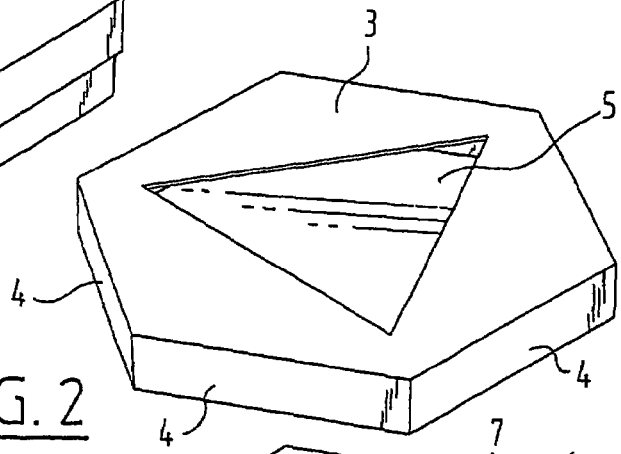
FIG. 2 shows the cover of said package.
Figure 3:
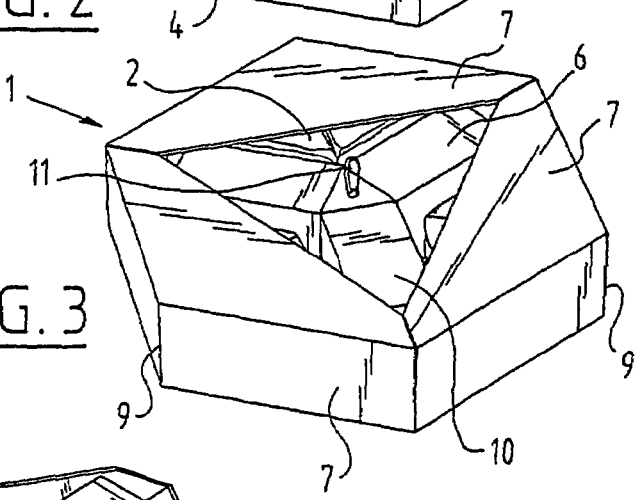
FIG. 3 shows the package without said cover.

Cover 3, which is separately shown in FIG. 2, is hexagonal when seen in top plan view, just like container 1, and it comprises a triangular window 5 of a transparent material. The shape of window 5 corresponds to the opening 6 of container 1 in closed position as shown in FIG. 3.

Figure 4:
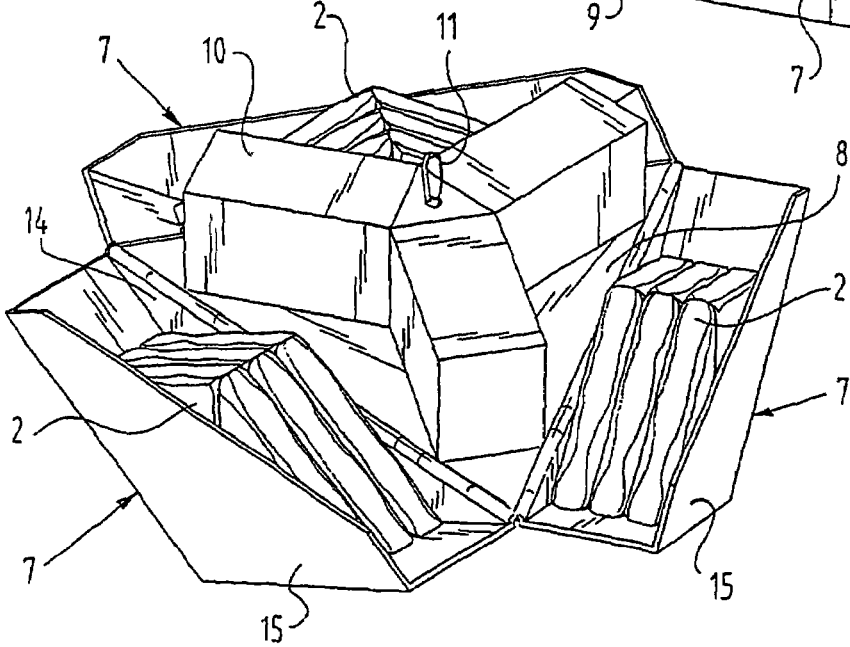
FIG. 4 is a perspective view of the first embodiment in open position.

In the first embodiment the package comprises three compartments 7, which are pivotally connected to bottom part 8 (FIG. 4). Each compartment 7 forms a holder, in which six delicacies 2 in the form of packaged pieces of chocolate are present. In the closed position of the package (FIGS. 1 and 3) the delicacies 2 are partially visible, and in the open position of the package (FIG. 4) the delicacies 2 can be removed from the package.

In the open position of the package, as is shown in FIG. 4, the package forms an attractive display for presenting delicacies, and the package can be placed on a flat surface. The package is thereby stably supported on said surface because each compartment 7 is in contact with the surface via a straight edge 9 (as shown in FIG. 3).

Present on bottom part 8 is a dividing element 10, which on the one hand functions to strengthen bottom part 8 and which on the other hand, in the closed position of the package, separates the compartments 7 so that the delicacies 2 will remain in place. Dividing element 10 may be made of a plastic or of another material and be attached by gluing or clipping or the like to bottom part 8. Dividing element 10 may also be made of the same material as the other part of the package, for example paper or cardboard or plastics, and be formed separately or integrally with said other part from a blank. The dividing element 10 may be open or may be openable to form an additional compartment for the delicacies 2 or for containing other food item or non-food element such as aromatic substance, electric light bulb plus power supply, cigarette, coffee stirrer etc. Dividing element 10 could be fabricated separately and may be removable, e.g. for addition of inscription or gift.

At its upper side dividing element 10 includes a gripping element 11, for example consisting of a string loop. In the closed position of the package, with the cover 3 removed, the gripping element 11 can be taken hold of by hand, so that the package can be lifted. Since the compartments 7 pivot with respect to bottom part 8 thereby, that is, pivot in downward direction, the package will be converted from the closed position (FIG. 3) to the open position (FIG. 4).

Figure 5:
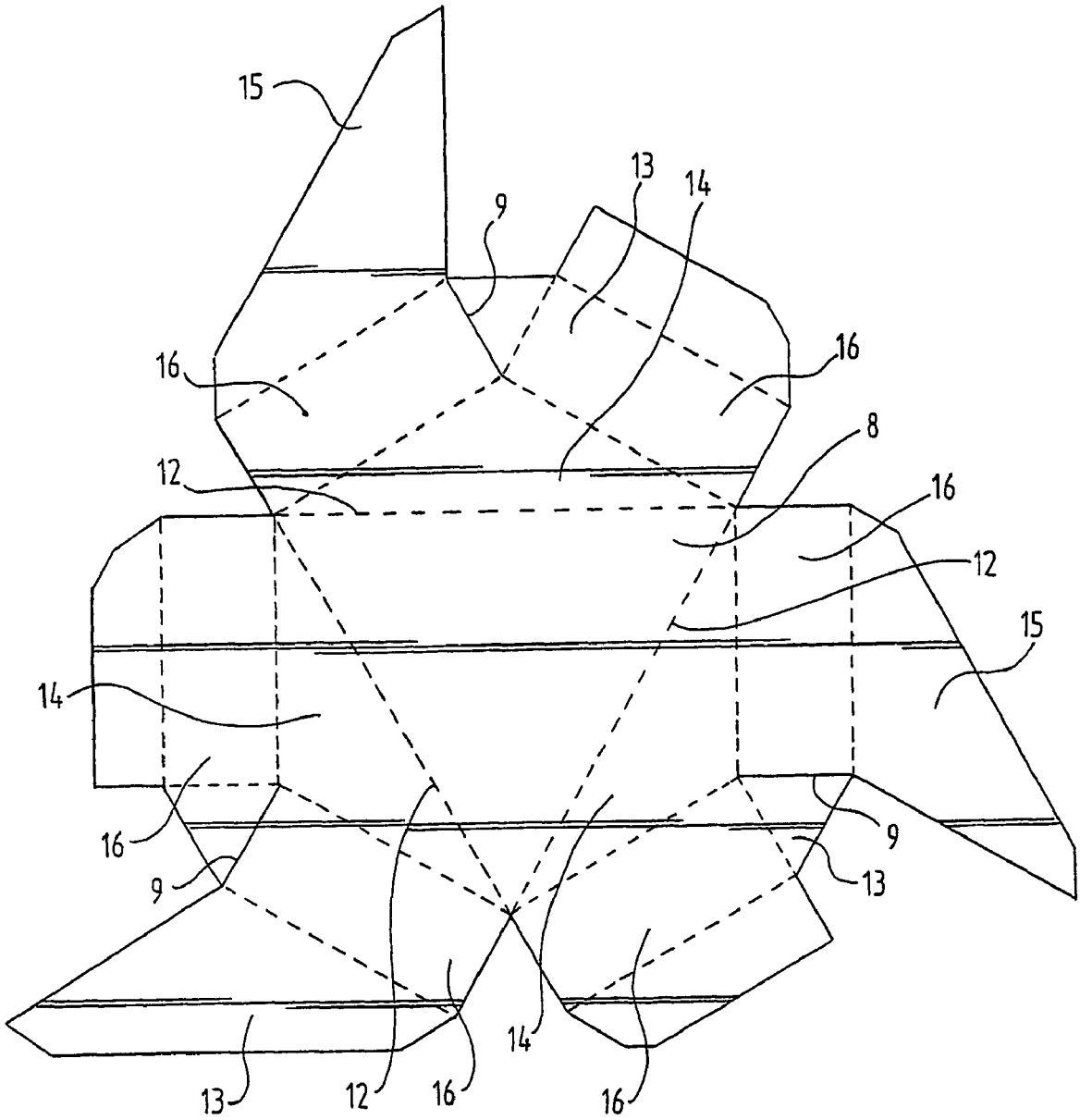
FIG. 5 shows the blank from which a part of the package of FIGS. 3 and 4 has been formed.

FIG. 5 shows a blank for forming the container according to FIG. 3, that is, the container that is formed by the bottom part 8 and the compartments 7 in the closed position of the package. Bottom part 8 is enclosed by three folding lines 12, and a compartment 7 is pivotally connected to the bottom part via each folding line 12. A compartment 7 is formed from each of the parts 13 of the blank by folding and gluing. Each part 13 comprises a wall part 14, which lies in the same plane as bottom part 8 in the closed position of the package and which forms a side wall of compartment 7 in the open position. Part 15 of each part 13 of the blank forms the other side wall of the compartment 7. The parts 16 of each part 13 form side walls of the package in the closed position (FIG. 3) and bottom walls of compartment 7 in the open position (FIG. 4) of the package. The three edges 9 can thereby rest on a supporting surface.

Figure 6:
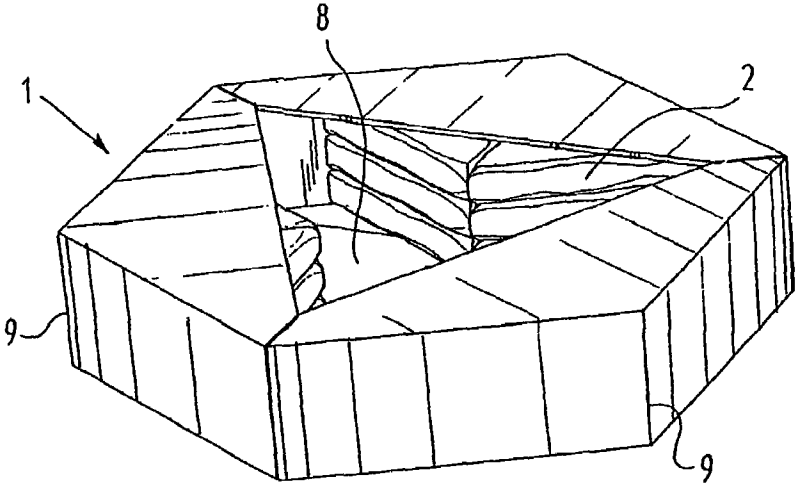
FIGS. 6 and 7 show a second embodiment of a package.
Figure 7:
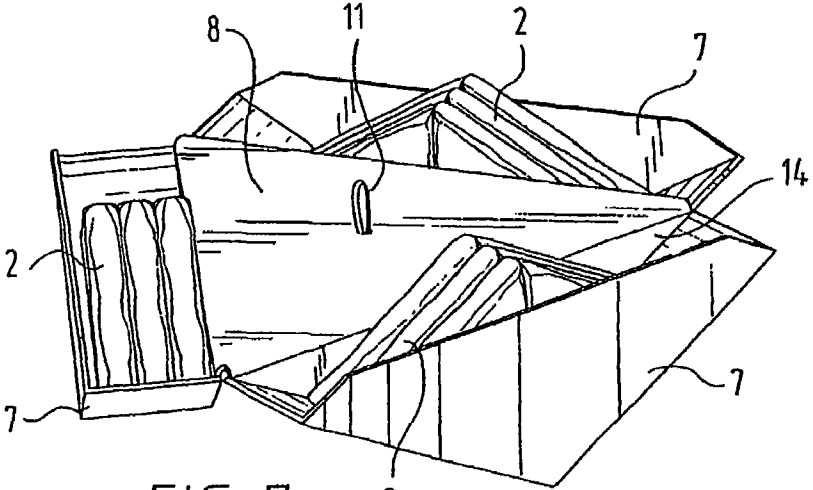

FIGS. 6 and 7 show a second embodiment, which partially corresponds to the first embodiment, but which does not have a dividing element 10. Consequently, gripping element 11 is attached to bottom part 8. The illustrated delicacies 2 can be held in place by being clamped in position within the package. The package may also contain loose delicacies, however. In that case care must be taken when opening the package that the delicacies land in each of the three compartments 7.

Figure 8:
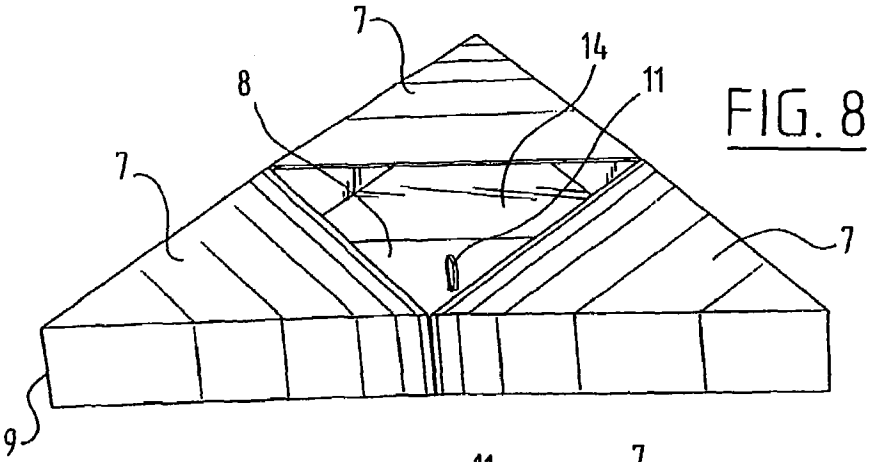
FIGS. 8 and 9 show a third embodiment.
Figure 9:
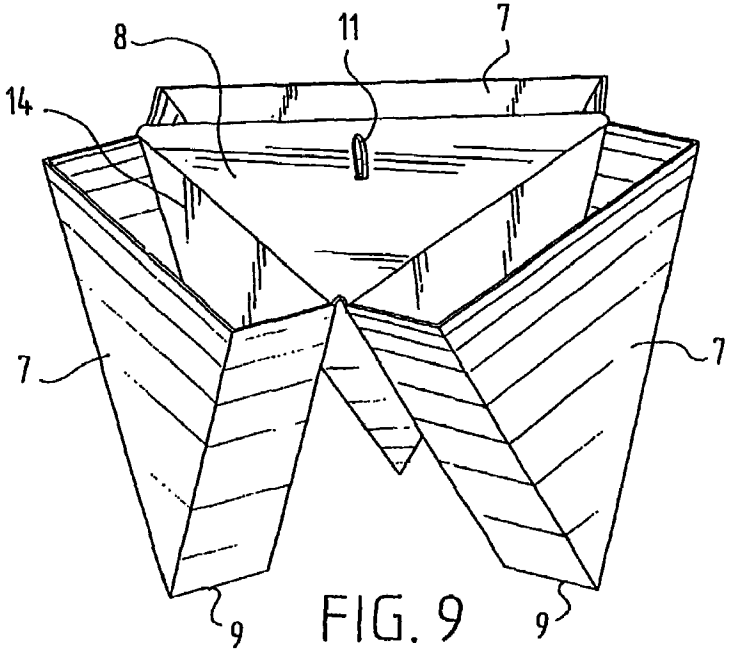

FIGS. 8 and 9 show a third embodiment, wherein the compartments 7 have a shape different from the shape that is shown in FIGS. 6 and 7. The shape of the compartments 7 is such that, seen in top plan view, the package is triangular in the closed position thereof. As a result, much deeper compartments 7 are obtained, which may be advantageous when packaging delicacies 2 having a shape adapted thereto.

Figure 10:
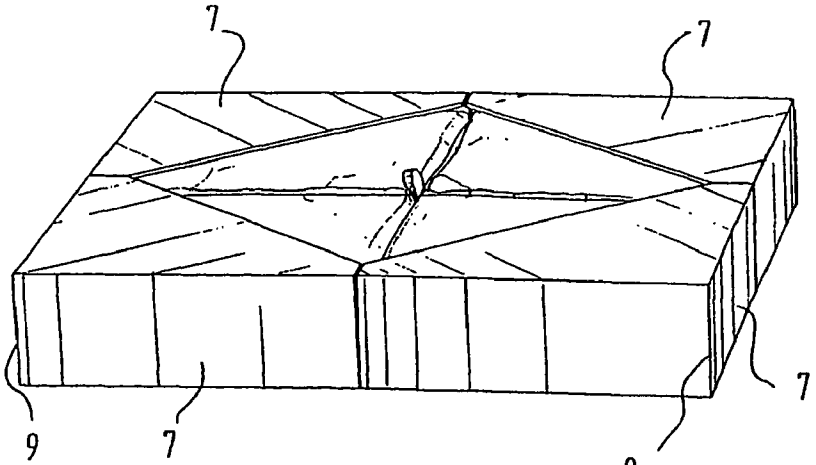
FIGS. 10 and 11 show a fourth embodiment.
Figure 11:
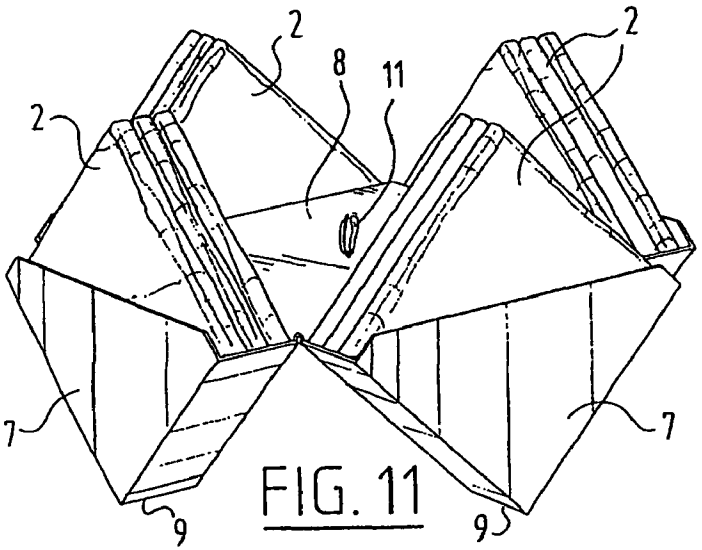

In the fourth embodiment of the package, which is shown in FIGS. 10 and 11, four compartments 7 are present, which are pivotally connected to a square bottom part 8. This shape of the package may be advantageous when packaging delicacies 2 that are square, as appears from FIG. 11.

Figure 12:
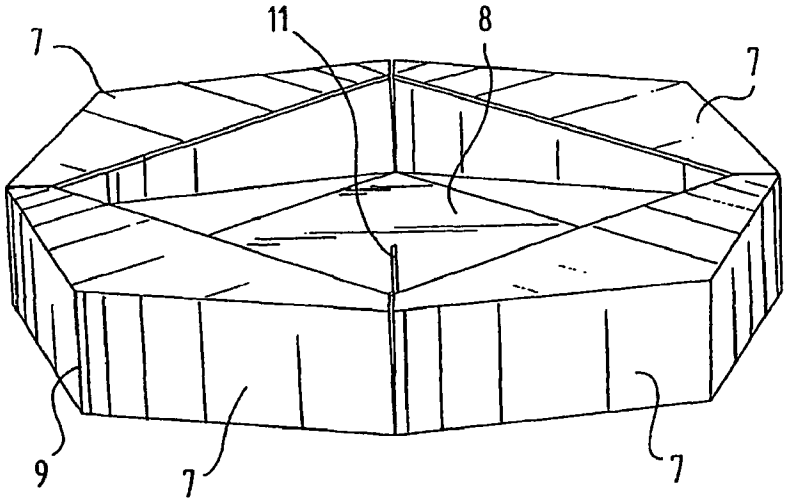
FIGS. 12 and 13 show a fifth embodiment.
Figure 13:
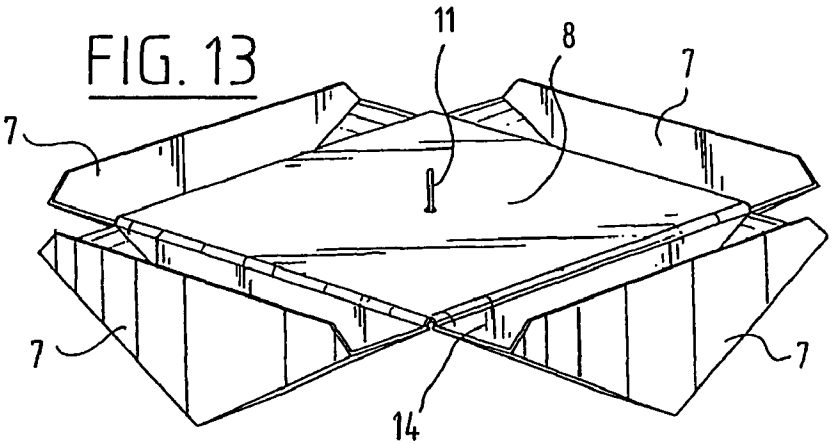

The fifth embodiment of the package, which is shown in FIGS. 12 and 13, likewise comprises a square bottom part 8, but the compartments 7 are less deep, so that the closed package (FIG. 12) is octagonal, seen in top plan view.

The second, the third, the fourth as well as the fifth embodiment may be provided with a cover as shown with the first embodiment. The cover will be triangular, square, hexagonal or octagonal in that case, depending on the shape of the closed package in top plan view.

Figure 14:
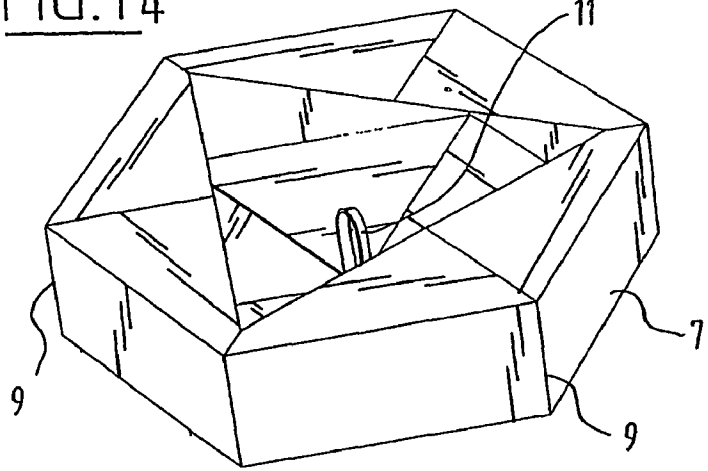
FIGS. 14 and 15 show a sixth embodiment.
Figure 15:
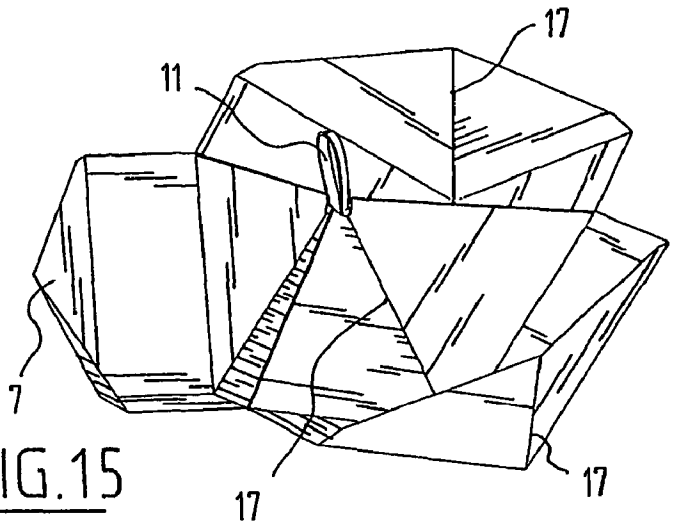

FIGS. 14 and 15 show a sixth embodiment. Thereby the all parts of the bottom of the container 1 are pivoted downwards so that no bottom part 8 remains in a horizontal position. Therefore the walls 14 and 15 of the compartments 7 are not flat but are folded at folding lines 17.

Figure 16:
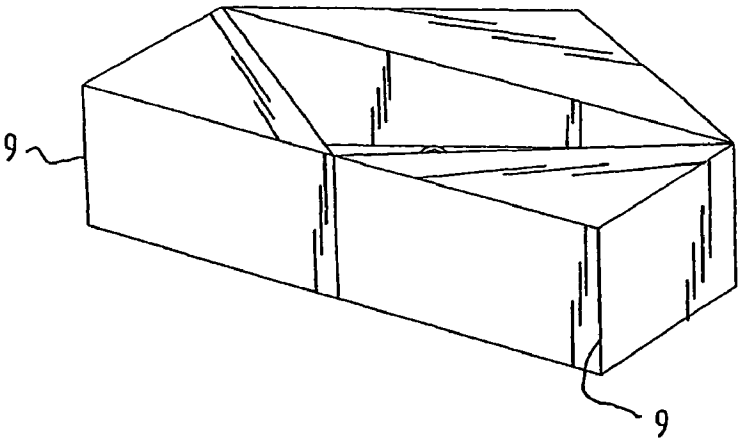
FIGS. 16 and 17 show a seventh embodiment.
Figure 17:
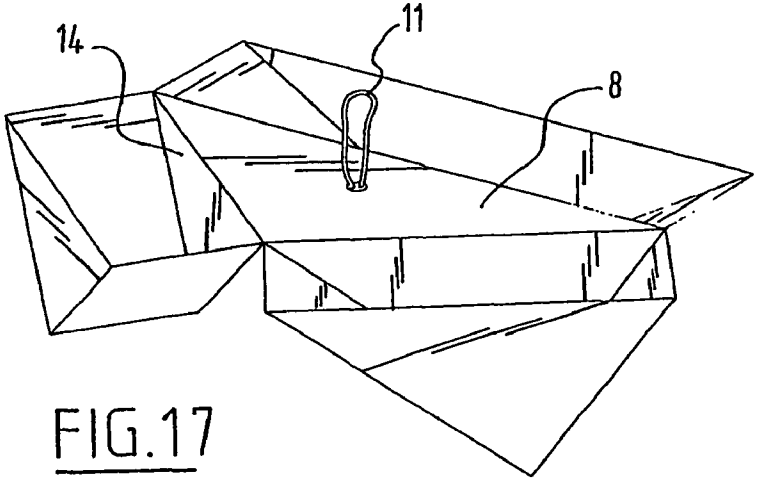

FIGS. 16 and 17 show an embodiment whereby the bottom part 8 is not an equilateral polygon. Therefore the compartments 7 have different dimensions.

Figure 18:
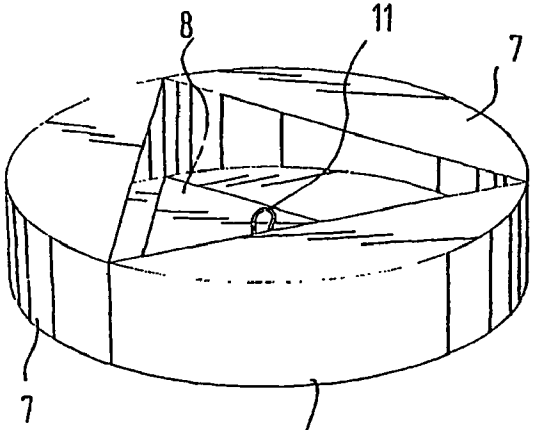
FIGS. 18 and 19 show an eighth embodiment.
Figure 19:
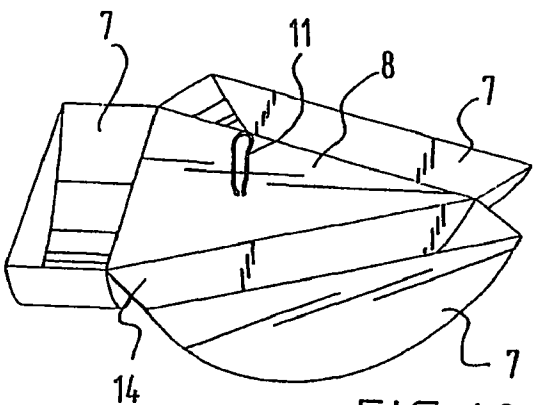

The eighth embodiment as shown in FIGS. 18 an 19 has a circular shape when seen from above and the compartments 7 have a corresponding shape.

Figure 20:
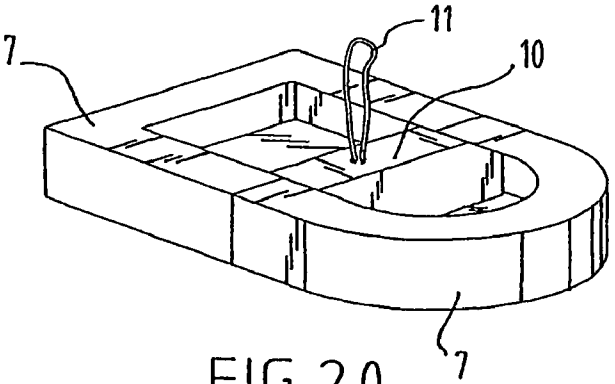
FIGS. 20 and 21 show a ninth embodiment.
Figure 21:
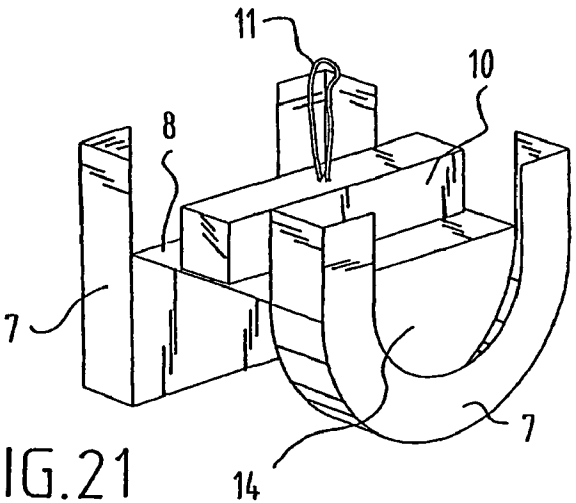
Figure 22:
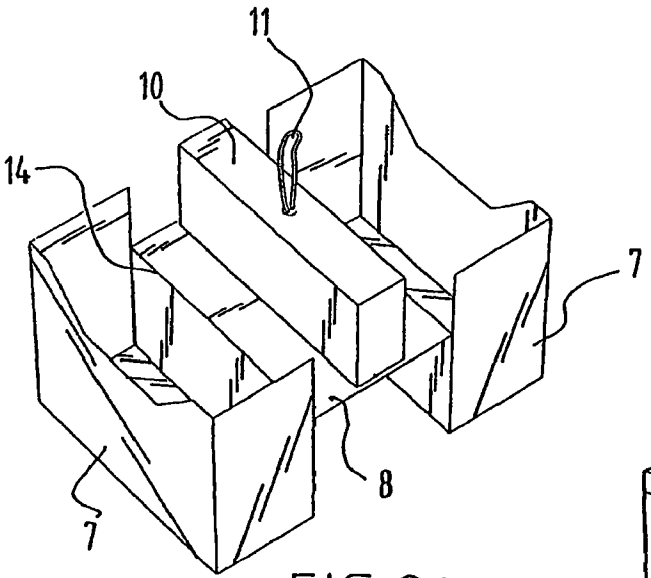
FIG. 22 shows a tenth embodiment.

FIGS. 20 and 21 show that there is no need to make the shape of the package symmetrical. According to this ninth embodiment the compartments 7 have a quite different shape. FIG. 22 show an embodiment with two compartments 7 having the same shape.

The illustrated embodiments are merely examples, many other embodiments are possible.

The invention claimed is:

1. A package for several delicacies (2) comprising compartments (7), which are pivotally connected to the sides of a polygonal bottom part (8), said package having:

a closed position wherein in said open position the bottom part (8) forms a portion of a flat bottom of a container (1) for the delicacies (2), each compartment (7) is a part of said container, and the package comprises vertical flat walls meeting at substantially vertical edges (9); and an open position wherein the compartments (7) have been pivoted downwards forming several holders for delicacies (2) that are open at upper sides of said compartments and the package can rest on a flat supporting surface with only said edges (9) of said flat walls and wherein said edges (9) extend in a radial direction relative to the central perpendicular axis through the bottom part (8).

2. A package for several delicacies (2) comprising compartments (7) which are pivotally connected to the sides of a polygonal bottom part (8), said package having:

a closed position wherein in said open position the bottom part (8) forms a portion of a flat bottom of a container (1) for the delicacies (2), each compartment (7) is a part of said container, and the package comprises a vertical cylindrical wall; and an open position wherein the compartments (7) have been pivoted downwards forming several holders for delicacies (2) that are open at upper sides of said compartments and the package can rest on a flat supporting surface with only lines of tangential points of said cylindrical wall and wherein said lines of tangential points extend in a radial direction relative to the central perpendicular axis through the bottom part (8).

3. A package according to claim 1 or 2, wherein in the closed position of the package a wall part (14) of each compartment (7) forms a portion of a flat bottom of said container (1).

4. A package according to claim 1 or 2, wherein the package includes a cover (3) which, in the closed position of the package, closes an upper side of the container (1), said cover (3) extending over side walls of said container (1).

5. A package according to claim 1 or 2, wherein a central part of the container (1) is provided with a gripping element (11), which can be taken hold of by hand.

6. A package according to claim 1 or 2, wherein a bottom of the container (1) is provided with a dividing element (10), which forms walls between the compartments (7) in the closed position of the package.

7. A package according to claim 1 or 2, wherein said package contains delicacies (2) having a shape that matches the shape of each compartment (7), such that at least one of said delicacies (2) fits in said compartment (7).

8. A method for packaging delicacies (2), comprising the step of packaging said delicacies (2) in a package according to claim 1 or 2.

* * * * *

UNITED STATES PATENT AND TRADEMARK OFFICE

CERTIFICATE OF CORRECTION

PATENT NO. : 7,159,760 B2
APPLICATION NO. : 10/433299
DATED : January 9, 2007
INVENTOR(S) : Deborah Pluck et al.

It is certified that error appears in the above-identified patent and that said Letters Patent is hereby corrected as shown below:

ON THE TITLE PAGE ITEM [30]:

Foreign Applicatin Priority Data, "Dec. 6, 2000 (EP) ..... 00204359"
should read --Dec. 6, 2000 (EP) ..... 0024359.4--.

ON THE TITLE PAGE ITEM [57] ABSTRACT:

Line 8, "compartment" should read --compartments--.

COLUMN 1:

Line 8, "batches" should read --batches.--;
Line 26, "have" should read --has--; and
Line 64, "edges" should read --edges of--.

COLUMN 3:

Line 6, "and" should be deleted; and
Line 19, "embodiment," should read --embodiment;--.

COLUMN 4:

Line 42, "from" should read --in--; and
Line 48, "embodiment" should read --embodiments--.

UNITED STATES PATENT AND TRADEMARK OFFICE

CERTIFICATE OF CORRECTION

PATENT NO. : 7,159,760 B2
APPLICATION NO. : 10/433299
DATED : January 9, 2007
INVENTOR(S) : Deborah Pluck et al.

It is certified that error appears in the above-identified patent and that said Letters Patent is hereby corrected as shown below:

COLUMN 5:

Line 3, "The invention" should read --What is--;
Line 7, "in said open position" should be deleted;
Line 18, "wherein" should read --wherein in said open position,--.

Signed and Sealed this

Seventeenth Day of July, 2007

JON W. DUDAS
*Director of the United States Patent and Trademark Office*